US012054796B2

(12) United States Patent
Mizoguchi et al.

(10) Patent No.: US 12,054,796 B2
(45) Date of Patent: Aug. 6, 2024

(54) METHOD FOR PRODUCING STEEL

(71) Applicant: NIPPON STEEL CORPORATION, Tokyo (JP)

(72) Inventors: Toshiaki Mizoguchi, Tokyo (JP); Jun Takekawa, Tokyo (JP); Shintaro Oga, Tokyo (JP); Hidenori Kurimoto, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 889 days.

(21) Appl. No.: 17/255,186

(22) PCT Filed: Jun. 26, 2019

(86) PCT No.: PCT/JP2019/025462
§ 371 (c)(1),
(2) Date: Dec. 22, 2020

(87) PCT Pub. No.: WO2020/004496
PCT Pub. Date: Jan. 2, 2020

(65) Prior Publication Data

US 2021/0262049 A1 Aug. 26, 2021

(30) Foreign Application Priority Data

Jun. 26, 2018 (JP) ..... 2018-121385

(51) Int. Cl.
*C21C 7/06* (2006.01)
*C22C 38/00* (2006.01)
*C22C 38/02* (2006.01)
(Continued)

(52) U.S. Cl.
CPC ..... *C21C 7/06* (2013.01); *C22C 38/002* (2013.01); *C22C 38/005* (2013.01); *C22C 38/02* (2013.01);
(Continued)

(58) Field of Classification Search
CPC ..... C21C 7/06; C21C 7/0645; C22C 38/002; C22C 38/005; C22C 38/02; C22C 38/04;
(Continued)

(56) References Cited

U.S. PATENT DOCUMENTS

2006/0260719 A1 11/2006 Mizoguchi et al.

FOREIGN PATENT DOCUMENTS

JP S56-5915 A 1/1981
JP S56-47510 A 4/1981
(Continued)

OTHER PUBLICATIONS

Shirota et al., Development of Production Process of Highly Clean Steel, CAMP-ISIJ, vol. 4 (1991), p. 1214, Japan.

*Primary Examiner* — Anthony M Liang
*Assistant Examiner* — Danny N Kang
(74) *Attorney, Agent, or Firm* — Myers Wolin, LLC

(57) ABSTRACT

A method for producing steel includes: (a) a step of adding the first group of alloys to molten steel having an amount of dissolved oxygen of 0.0050 mass % or more; (b) a step of, after the step of (a), adding deoxidizer to the molten steel for deoxidation; (c) a step of, after the step of (b), adding the second group of alloys to the deoxidized molten steel; and (d) a step of, after the step of (c), adding REM to the molten steel, wherein amounts of oxygen $O_b$ introduced from the first group of alloys (mass %) and amounts of oxygen $O_a$ introduced from the second group of alloys (mass %) satisfy [$O_a \leq 0.00100$], [$O_b + O_a \geq 0.00150$], and [$O_b/O_a \geq 2.0$], and satisfy a formula [$0.05 \leq REM/T.O \leq 0.5$] after the step of (d).

14 Claims, 1 Drawing Sheet

(51) Int. Cl.

| | |
|---|---|
| ***C22C 38/04*** | (2006.01) |
| ***C22C 38/06*** | (2006.01) |
| ***C22C 38/40*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/54*** | (2006.01) |

(52) U.S. Cl.
CPC ..... *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01)

(58) Field of Classification Search
CPC ..... C22C 38/06; C22C 38/42; C22C 38/44; C22C 38/46; C22C 38/48; C22C 38/50; C22C 38/54; C22C 38/00; C22C 38/60; C22C 38/58
See application file for complete search history.

(56) References Cited

FOREIGN PATENT DOCUMENTS

| | | | |
|---|---|---|---|
| JP | H9-192799 | A | 7/1997 |
| JP | 2000-144330 | A | 5/2000 |
| JP | 2005-2425 | A | 1/2005 |
| JP | 2008-260979 | A | 10/2008 |

METHOD FOR PRODUCING STEEL

CROSS-REFERENCE TO RELATED APPLICATION

This application is a national stage application of International Application No. PCT/JP2019/025462, filed on Jun. 26, 2019 and designated the U.S., which claims priority to Japanese Patent Application No. 2018-121385, filed on Jun. 26, 2018. The contents of each are herein incorporated by reference.

TECHNICAL FIELD

The present disclosure relates to a method for producing steel.

BACKGROUND ART

In a production process of steel, deoxidizer is used to remove oxygen, which can be a cause of an adverse influence on properties. As the deoxidizer, an element that has a strong action of binding with oxygen to form oxide is generally used. This is because addition of the deoxidizer to molten steel can cause formation of oxide, so as to isolate oxygen from the molten steel.

A most typical element as the deoxidizer is Al. In a case where Al is used as the deoxidizer, oxide of Al, or alumina, is formed. Particles of the alumina agglomerate to form coarse clusters (hereinafter, also referred to as "alumina clusters").

The alumina clusters have an adverse effect on properties of steel. Specifically, it is known that the alumina clusters cause surface flaws (sliver defects), poor material quality, and defects on steel sheets or plates such as thick plates and sheets and steel materials such as steel pipes. Moreover, the alumina clusters also cause clogging in an immersion nozzle serving as a flow passage of molten steel in continuous casting.

For example, Patent Documents 1 and 2 disclose steel in which the formation of alumina clusters is prevented or reduced without use of Al as deoxidizer and methods for producing the steel.

In addition, as a method for making the alumina clusters harmless, a known method is one in which Ca is added to molten steel to control formation of alumina or to prevent or reduce the formation itself. As an example of the method, Patent Document 3 and Non-Patent Document 1 disclose methods for reforming oxide-based inclusions such as alumina or for preventing or reducing the formation of the oxide-based inclusions itself by using Ca.

LIST OF RELATED ART DOCUMENTS

Patent Document

Patent Document 1: JP56-5915A
Patent Document 2: JP56-47510A
Patent Document 3: JP9-192799A
Patent Document 4: JP2005-2425A

Non Patent Document

Non-Patent Document 1: CAMP-ISIJ, 4 (1991), p. 1214 (Shirota et al.)

SUMMARY

Technical Problem

Al is an element that is most typically used as the deoxidizer from the viewpoint of production costs. For this reason, production costs of the steels described in Patent Documents 1 and 2 are high because of not using Al. Therefore, Patent Documents 1 and 2 are not suitable for mass production of steel. In addition, the steels disclosed in Patent Document 3 and Non-Patent Document 1 are not applicable to steel plates for automobiles, and their steel materials have limited applications.

The present inventors thus conducted studies about a mechanism of how the alumina clusters form. A possible factor of clustering alumina is presence of FeO in molten steel. In general, a temperature of molten steel is about 1600° C., while a melting point of FeO is about 1370° C. It has been therefore considered that, in molten steel that is considered having reached its equilibrium condition after a lapse of adequate time, FeO is totally melted and not present.

However, when viewed microscopically, it was found that there is a portion in the molten steel where the equilibrium condition is not established despite the lapse of adequate time, and FeO is actually present in its liquid state. The presence of FeO acts as a binder that binds alumina particles, serving as a cause of forming coarse aggregates of alumina, namely, alumina clusters.

Accordingly, it is desired to reduce FeO in the molten steel. Here, by adding a trace amount of REM, which has a strong action of binding with O as compared with Fe, REM binds with O to REM oxide, by which FeO in the molten steel can be reduced. Based on such a mechanism of the formation of FeO, Patent Document 4 discloses the steel in which the formation of the alumina clusters is prevented or reduced.

At the same time, to a steel having high level properties such as strength properties, various elements are added. When added to the molten steel, the elements are added in a large quantity in forms of alloys. Such alloys for controlling a chemical composition of steel typically contain oxygen. Therefore, although REM is used to restrain the formation of FeO, the addition of the alloys for controlling the chemical composition causes FeO to form again. As a result, there is a problem in that the production of the alumina clusters cannot be prevented or reduced, but surface flaws, poor material quality, defects occur.

An objective of the present disclosure is to provide a method for producing steel, which is intended to solve the problem described above, prevents or reduces production of the alumina clusters, and prevents or reduces surface flaws, poor material quality, and defects of the steel.

Solution to Problem

The present disclosure has been made to solve the above problems and has a gist of the following method for producing steel.

(1) A method for producing steel, including:

(a) a step of adding the first group of alloys to molten steel having an amount of dissolved oxygen of 0.0050 mass % or more;

(b) a step of, after the step of (a), adding deoxidizer to the molten steel for deoxidation;

(c) a step of, after the step of (b), adding the second group of alloys to the deoxidized molten steel; and (d) a step of, after the step of (c), adding REM to the molten steel, wherein amounts of oxygen introduced from the first group of alloys and amounts of oxygen introduced from the second group of alloys satisfy following Formulas (i) to (iii), and after the step of (d), the ratio between REM and T.O satisfies following Formula (iv):

$$O_a \leq 0.00100 \quad \text{(i)}$$

$$O_b + O_a \geq 0.00150 \quad \text{(ii)}$$

$$O_b / O_a \geq 2.0 \quad \text{(iii)}$$

$$0.05 \leq REM/T.O \leq 0.5 \quad \text{(iv)}$$

where symbols in the formulas are defined as follows.

$O_b$: The amounts of oxygen introduced from the first group of alloys (mass %)

$O_a$: The amounts of oxygen introduced from the second group of alloys (mass %)

REM: Content of REM (mass %)

T.O: Total content of oxygen (mass %)

(2) The method for producing steel according to the above (1), wherein the first group of alloys and the second group of alloys are each one or more kinds selected from manganese metal, titanium metal, copper metal, nickel metal, FeMn, FeP, FeTi, FeS, FeSi, FeCr, FeMo, FeB, and FeNb.

(3) The method for producing steel according to the above (1) or (2), wherein the chemical composition of the steel consists of, in mass %:

C: 0.0005 to 1.5%;
Si: 0.005 to 1.2%;
Mn: 0.05 to 3.0%;
P: 0.001 to 0.2%;
S: 0.0001 to 0.05%;
T.Al: 0.005 to 1.5%;
Cu: 0 to 1.5%;
Ni: 0 to 10.0%;
Cr: 0 to 10.0%;
Mo: 0 to 1.5%;
Nb: 0 to 0.1%;
V: 0 to 0.3%;
Ti: 0 to 0.25%;
B: 0 to 0.005%;
REM: 0.00001 to 0.0020%; and
T.O: 0.0005 to 0.0050%,
with the balance being Fe and impurities.

(4) The method for producing steel according to the above (3), wherein the chemical composition of the steel contains one or more elements selected from, in mass %:

Cu: 0.1 to 1.5%;
Ni: 0.1 to 10.0%;
Cr: 0.1 to 10.0%; and
Mo: 0.05 to 1.5%.

(5) The method for producing steel according to the above (3) or (4), wherein the chemical composition of the steel contains one or more elements selected from, in mass %:

Nb: 0.005 to 0.1%;
V: 0.005 to 0.3%; and
Ti: 0.001 to 0.25%.

(6) The method for producing steel according to any one of the above (3) to (5), wherein the chemical composition of the steel contains, in mass %, B: 0.0005 to 0.005%.

(7) The method for producing steel according to any one of the above (1) to (6), wherein in the steel, a maximum diameter of alumina clusters is 100 μm or less.

(8) The method for producing steel according to the above (7), wherein in the steel, numbers of alumina clusters having diameters of 20 μm or more are 2.0 clusters/kg or less.

Advantageous Effects

The present disclosure provides steel for which the problem described above is solved, in which production of the alumina clusters is prevented or reduced, and in which surface flaws, poor material quality, and defects of the steel are prevented or reduced.

DESCRIPTION OF EMBODIMENTS

Figure 1:
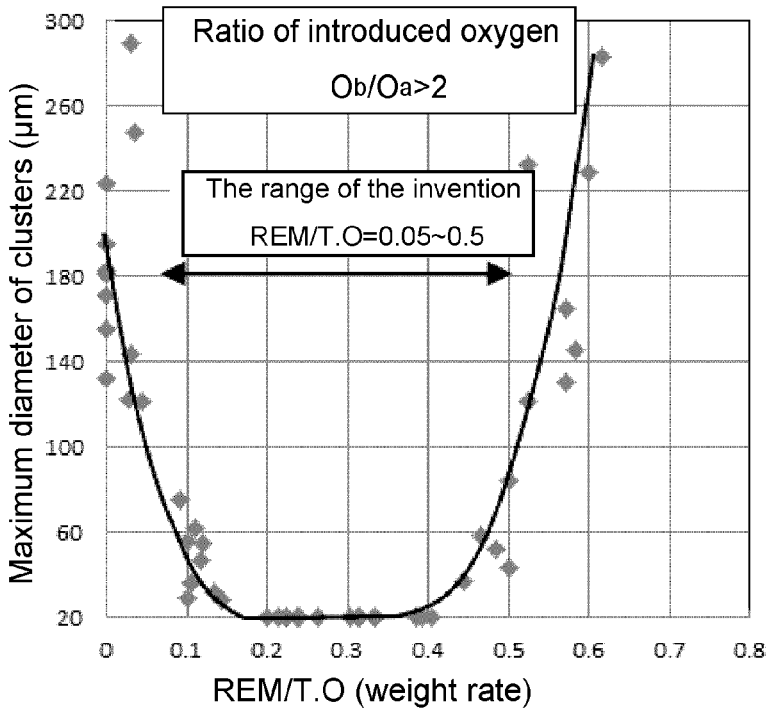
FIG. 1 is a graph illustrating a relation between REM/T.O and maximum diameter of alumina clusters.
Figure 2:
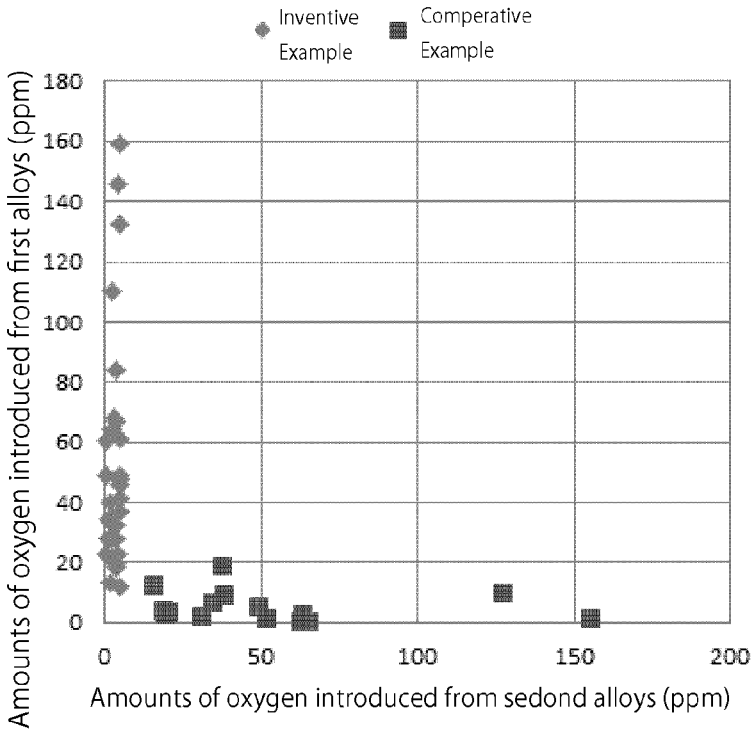
FIG. 2 is a graph illustrating a relation between amounts of oxygen introduced from the first group of alloys and amounts of oxygen introduced from the second group of alloys in inventive examples of the present disclosure and comparative examples.

The present inventors conducted various studies to reduce production of alumina clusters, so as to prevent or reduce surface flaws and defects of a steel material and improve material quality properties. As a result, the following findings (a) to (d) were obtained.

(a) In order to provide various properties such as strength, corrosion resistance, heat-resistant properties, and workability to steel, it is necessary to control a chemical composition of the steel. For the control of the chemical composition, additional elements are used. The additional elements are usually added to molten steel in a large quantity in forms of alloys as raw materials to be melted.

(b) In general, deoxidizers such as Al are added to the molten steel, and after deoxidation of the steel is finished, raw materials to be melted in the forms of alloys for the control of the components of the steel (hereinafter, also referred to simply as "alloy") is added to the molten steel. The alloys contain oxygen, albeit in a trace quantity; therefore, addition of the alloys in a large quantity increases amounts of oxygen contained in the molten steel.

(c) The introduced O produces FeO, which causes occurrence of alumina clusters, again in the molten steel. As a result, FeO is produced despite addition of REM. As seen from the above, in a case where the alloys are added in a large quantity, the formation of alumina clusters cannot be prevented or reduced despite addition of REM.

(d) Therefore, by adjusting the amounts of O introduced from the alloys used for controlling the chemical composition before and after the deoxidation, to add REM is effective.

A method for producing steel according to the present disclosure is made based on the findings described above. Requirements of the present disclosure will be described below in detail. Hereinafter, the symbol "%" for contents in description refers to "mass percent" unless otherwise noted.

1. Outline

The present disclosure relates to a method for producing steel, more specifically to a method for producing killed steel deoxidized with a deoxidizer described below. The present disclosure includes (a) a step of adding the first group of alloys to molten steel having amounts of dissolved oxygen of 0.0050 mass % or more, (b) a step of, after the step of (a), adding deoxidizer to the molten steel for deoxidation, (c) a step of, after the step of (b), adding the second group of alloys to the deoxidized molten steel, (d) a step of, after the step of (c), adding REM to the molten steel.

Amounts of oxygen introduced from the first group of alloys and amounts of oxygen introduced from the second group of alloys satisfy the following Formulas (i) to (iii):

$$O_a \leq 0.00100 \quad \text{(i)}$$

$$O_b + O_a \geq 0.00150 \quad \text{(ii)}$$

$$O_b / O_a \geq 2.0 \quad \text{(iii)}$$

where symbols in the formulas are defined as follows.

$O_b$: The amounts of oxygen introduced from the first group of alloys (mass %)

$O_a$: The amounts of oxygen introduced from the second group of alloys (mass %)

Moreover, the steel satisfies the following Formula (iv) after the step of (d).

$$0.05 \leq REM/T.O \leq 0.5 \quad \text{(iv)}$$

Here, symbols in the formulas are defined as follows.

REM: Content of REM (mass %)

T.O: Total content of oxygen (mass %)

Hereinafter, the step of (a) will be referred to as a step of adding the first group of alloys, the step of (b) will be referred to as a deoxidation step, the step of (c) will be referred to as a step of adding the second group of alloys, and the step of (d) will be referred to as a REM addition step.

Note that the amounts of oxygen introduced from the first group of alloys and the second group of alloys are each defined as a total of O dissolved in the alloy as well as O contained in a form of oxides.

2. Production Process (a) Step of Adding the First Group of Alloys

In the step of adding the first group of alloys, the first group of alloys are added to molten steel of which amounts of dissolved oxygen is 0.0050 mass % or more before deoxidation. The first group of alloys in this step are a generic term for alloys to be added before the deoxidation step to control the components of the molten steel, which will be described below. Here, the amount of dissolved oxygen in the molten steel is preferably set at 0.0500 mass % or less. Note that deoxidation effect can be obtained by decarburization before the step of adding the first group of alloys. In order to set the amounts of dissolved oxygen in the molten steel at 0.0500 mass %, deoxidizer may be added to the molten steel. These do not interfere with advantageous effects of the present disclosure at all.

In the step of adding the first group of alloys, one or more kinds of alloys selected as the first group of alloys may be added at a time or a plurality of times, and a number of times of the addition is not limited specifically as long as the addition is performed before the deoxidation step. A timing for the addition of the first group of alloys is not limited specifically as long as the timing is prior to the deoxidation; for example, the first group of alloys are added to the molten steel in a converter, during tapping of the molten steel from the converter, or in the molten steel in a ladle after the tapping, or immediately before or during vacuum degassing.

(b) Deoxidation Step

After the step of (a), namely, the step of adding the first group of alloys, deoxidizer is added to the molten steel for deoxidation. There is no specific limitation on the deoxidizer; Al, Si, Zr, Al—Zr, Al—Si, or the like is typically used. Killed steels produced with the deoxidizer is also called Al killed steel, Zr killed steel, Al—Zr killed steel, or Al—Si killed steel. A timing for adding the deoxidizer is not limited specifically as long as the timing is after the addition of the first group of alloys and before the addition of the second group of alloys.

(c) Step of Adding the Second Group of Alloys (c) After the step of (b), namely, the deoxidation step, the second group of alloys are added to the deoxidized molten steel. The second group of alloys in this step are a generic term for alloys to be added after the deoxidation step to control the components of the molten steel, which will be described below. In the step of adding the second group of alloys, one or more kinds of alloys selected as the second group of alloys may be added at a time or a plurality of times, and a number of times of the addition is not limited specifically as long as the addition is performed after the deoxidation step and before the addition of REM.

(d) REM Addition Step (d) After the step of (c), namely, the step of adding the second group of alloys, REM is added to the molten steel. In the present disclosure, REM is a generic term for 17 elements including 15 lanthanoid elements as well as Y and Sc. One or more of these 17 elements can be contained in the steel material, and the content of REM means a total content of these elements.

REM to be added may be in a form of pure metal such as Ce and La, alloy of REM metals, or alloy of the REM metals and other metals, and a shape of REM may be lump-like, granular, wire-like, or the like. In order to make a concentration of REM uniform, it is desirable to add REM when circulating the molten steel in an RH vacuum degassing vessel or while stirring the molten steel in the ladle using Ar gas or the like.

3. First Group of Alloys and Second Group of Alloys 3-1. Definitions of First Group of Alloys and Second Group of Alloys In the present disclosure, the first group of alloys and the second group of alloys refer to alloys that are added to the molten steel to control the chemical composition of the steel (also containing metals for a raw material to be melted). As described above, the first group of alloys refer to alloys that are added in the step of adding the first group of alloys before deoxidation. As described above, the second group of alloys refer to alloys that are added in the step of adding the second group of alloys after the deoxidation.

The first group of alloys and the second group of alloys are each preferably one or more kinds selected from manganese metal, titanium metal, copper metal, nickel metal, FeMn, FeP, FeTi, FeS, FeSi, FeCr, FeMo, FeB, and FeNb.

The manganese metal is a metallic material containing Mn at a high concentration, for example, 99 mass % or more, for component control; this holds true for the titanium metal, the copper metal, and the nickel metal. A definition of the manganese metal is found in, for example, JIS G 2311:1986.

The above "FeMn" refers to "ferromanganese". For the other kinds of ferroalloys, a name of the corresponding element is appended to "Fe"; for example, "ferrochromium"

is denoted as "FeCr". The ferroalloys such as ferromanganese refer to alloys defined in JIS G 2301:1998 to JIS G 2304:1998, JIS G 2306:1998 to JIS G 2316:2000, JIS G 2318: 1998, JIS G 2319: 1998, and the like.

3-2. Amount of Oxygen Introduced from Alloys

The first group of alloys and the second group of alloys contain oxygen, albeit in a trace quantity. Amounts of oxygen introduced from all of the alloys selected as the first group of alloys (hereinafter, simply referred to as "amounts of oxygen introduced from the first group of alloys") is denoted by $O_b$. Amounts of oxygen introduced from all of the alloys selected as the second group of alloys (hereinafter, simply referred to as "amounts of oxygen introduced from the second group of alloys") is denoted by $O_a$.

Here, the amounts of oxygen introduced from the first group of alloys are calculated by the following procedure. Specifically, an amount of oxygen introduced from specific alloy added before deoxidation (mass %) is determined by Amount of added alloy (kg)×Concentration of oxygen in alloy (mass %)/Amount of molten steel (kg). According to the calculating formula, values of all amounts of oxygen introduced from each alloys added before the deoxidation are calculated, and the values are summed up, by which the amounts of oxygen introduced from the first group of alloys can be calculated.

Similarly, the amounts of oxygen introduced from the second group of alloys are calculated by the following procedure. Specifically, an amount of oxygen introduced from specific alloy added after the deoxidation (mass %) is determined by Amount of added alloy (kg)×Concentration of oxygen in alloy (mass %)/Amount of molten steel (kg). According to the calculating formula, values of amounts of oxygen introduced from each alloys added after the deoxidation are calculated, and the values are summed up, by which the amounts of oxygen introduced from the second group of alloys can be calculated.

The first group of alloys and the second group of alloys contain oxygen. The concentrations of oxygen in the alloys are, typically, manganese metal: about 0.5%, titanium metal: about 0.2%, copper metal: about 0.04%, nickel metal: about 0.002%, FeMn: about 0.4%, FeP: about 1.5%, FeTi: about 1.3%, FeS: about 6.5%, FeSi: about 0.4%, FeCr: about 0.1%, FeMo: about 0.01%, FeB: about 0.4%, and FeNb: about 0.03%.

The amounts of oxygen $O_b$ introduced from the first group of alloys and the amounts of oxygen $O_a$ introduced from the second group of alloys satisfy the following Formulas (i) to (iii):

$$O_a \leq 0.00100 \quad \text{(i)}$$

$$O_b + O_a \geq 0.00150 \quad \text{(ii)}$$

$$O_b / O_a \geq 2.0 \quad \text{(iii)}$$

where symbols in the formulas are defined as follows.

$O_b$: The amounts of oxygen introduced from the first group of alloys (mass %)

$O_a$: The amounts of oxygen introduced from the second group of alloys (mass %)

$O_a$ exceeding 0.00100, which is the right side value of Formula (i), fails to restrain $Al_2O_3$ and FeO from being produced. For this reason, $O_a$, which is the left side value of Formula (i), is set at 0.00100 or less, preferably 0.00050 or less. On the other hand, $O_a$ is preferably 0.00002 or more from a viewpoint of production costs and the like.

The left side value of Formula (ii), which is a sum of $O_b$ and $O_a$, is set at 0.00150 or more. This is because, if the left side value of Formula (ii) is less than 0.00150, the alloys for the control of the chemical composition cannot be added sufficiently, and thus steel with a desired chemical composition cannot be obtained. When the intention is to use REM to prevent or reduce alumina clusters effectively, the left side value of Formula (ii) is preferably set at 0.01700 or less.

The left side value of Formula (iii), which is a ratio between $O_b$ and $O_a$, is set at 2.0 or more. This is because, if the left side value of Formula (iii) is less than 2.0, the amounts of alloys added in the step of adding the second group of alloys after deoxidation becomes excessive, and thus a deoxidation effect brought by Al and the like cannot be obtained sufficiently. The left side value of Formula (iii) is preferably set at 2.5 or more, more preferably 10.0 or more, still more preferably 15.0 or more. In contrast, if the left side value of Formula (iii) exceeds 130, decrease in yield occurs, and thus productivity of the steel decreases. For this reason, the left side value of Formula (iii) is preferably set at 130 or less.

4. REM/T.O

In the producing method according to the present disclosure, REM is added to the molten steel after the step of adding the second group of alloys as described above (this corresponds to the REM addition step). In the REM addition step, REM is added to the molten steel, the molten steel is stirred sufficiently, and after a lapse of time, REM/T.O, which is a ratio between REM and T.O, satisfies the following Formula (iv).

$$0.05 \leq REM/T.O \leq 0.5 \quad \text{(iv)}$$

where symbols in the formulas are defined as follows.

REM: Content of REM (mass %)

T.O: Total content of oxygen (mass %)

FIG. 1 is a graph illustrating a relation between REM/T.O and maximum diameter of alumina clusters. As is clear from FIG. 1, the maximum diameter of alumina clusters significantly decreases when REM/T.O ranges between 0.05 and 0.5. This shows that adjusting REM/T.O to satisfy Formula (iv) is effective.

If the middle value of Formula (iv) is less than 0.05, an effect of preventing alumina particles from clustering together cannot be obtained. For this reason, the middle value of Formula (iv) is set at 0.05 or more, preferably 0.10 or more, more preferably 0.20 or more. In contrast, if the middle value of Formula (iv) exceeds 0.5, REM becomes excessive; in this case, clusters mainly made of REM oxides rather than alumina clusters are formed, resulting in poor material quality and the like. For this reason, the middle value of Formula (iv) is set at 0.5 or less. In order to prevent alumina clusters from clustering together more reliably, the middle value of Formula (iv) is preferably set at 0.15 or more and 0.4 or less.

Here, the content of REM and the total content of oxygen are desirably managed (measured) with molten steel samples that are extracted after the RH process or taken from TD (tundish) performed after the addition of REM and before casting. However, in a case of difficulty in the extraction, cast pieces after the casting may be used as the samples to be managed (measured). This is because it is considered that the above numerical values remain unchanged even after the molten steel is formed into the cast pieces.

5. Chemical Composition of Steel

A chemical composition of steel produced according to the present disclosure (killed steel) will be described below.

The chemical composition of the steel according to the present disclosure (killed steel) preferably includes, in mass %, C: 0.0005 to 1.5%, Si: 0.005 to 1.2%, Mn: 0.05 to 3.0%, P: 0.001 to 0.2%, S: 0.0001 to 0.05%, T.Al: 0.005 to 1.5%, Cu: 0 to 1.5%, Ni: 0 to 10.0%, Cr: 0 to 10.0%, Mo: 0 to 1.5%, Nb: 0 to 0.1%, V: 0 to 0.3%, Ti: 0 to 0.25%, B: 0 to 0.005%, REM: 0.00001 to 0.0020%, and T.O: 0.0005 to 0.0050%, and the balance being Fe and impurities.

The steel produced according to the present disclosure can be subjected to working, heat treatment, and the like as necessary to be produced into a steel material such as a sheet, a thick plate, a pipe, a section shape steel, and a steel bar.

C: 0.0005 to 1.5%

C (carbon) is a basic element that most increases strength of steel with stability. In order to ensure necessary strength or hardness, a content of C is preferably set at 0.0005% or more. However, if the content of C is more than 1.5%, toughness of steel decreases. The content of C is therefore preferably set at 1.5% or less. The content of C is preferably adjusted within a range between 0.0005 to 1.5% in accordance with a desired strength of a material.

Si: 0.005 to 1.2%

If a content of Si (silicon) is less than 0.005%, there arises a necessity to perform hot metal pretreatment, which puts a significant burden on refining, resulting in decrease in economic efficiency. The content of Si is therefore preferably set at 0.005% or more. However, if the content of Si is more than 1.2%, poor plating occurs, resulting in decrease in surface properties and corrosion resistance of steel. The content of Si is therefore preferably set at 1.2% or less. The content of Si is preferably adjusted within a range between 0.005 to 1.2%.

Mn: 0.05 to 3.0%

If a content of Mn (manganese) is less than 0.05%, a refining time increases, resulting in decrease in economic efficiency. The content of Mn is therefore preferably set at 0.05% or more. However, if the content of Mn is more than 3.0%, workability of steel significantly deteriorates. The content of Mn is therefore preferably set at 3.0% or less. The content of Mn is preferably adjusted within a range between 0.05 to 3.0%.

P: 0.001 to 0.2%

If a content of P (phosphorus) is less than 0.001%, the hot metal pretreatment will be time consuming and costly, resulting in decrease in economic efficiency. The content of P is preferably set at 0.001% or more. However, if the content of P is more than 0.2%, workability of steel significantly deteriorates. The content of P is therefore preferably set at 0.2% or less. The content of P is preferably adjusted within a range between 0.001 to 0.2%.

S: 0.0001 to 0.05%

If a content of S (sulfur) is less than 0.0001%, the hot metal pretreatment will be time consuming and costly, resulting in decrease in economic efficiency. The content of S is therefore preferably set at 0.0001% or more. However, if the content of S is more than 0.05%, workability and corrosion resistance of steel significantly deteriorates. The content of S is therefore preferably 0.05% or less. The content of S is preferably adjusted within a range between 0.0001 to 0.05%.

T.Al: 0.005 to 1.5%

In the present disclosure, regarding a content of Al (aluminum), a sum of an amount of acid-soluble Al (sol.Al), which has an influence on material quality, and an amount of Al derived from $Al_2O_3$ being inclusions (insol.Al) is defined as T.Al (Total.Al). In other words, this means T.Al=sol.Al+insol.Al.

If a content of T.Al is less than 0.005%, Al traps N in a form of AlN, failing to reduce dissolved N. The content of T.Al is therefore preferably set at 0.005% or more. However, if the content of T.Al is more than 1.5%, surface properties and workability of steel decrease. The content of T.Al is therefore preferably set at 1.5% or less. The content of T.Al is preferably adjusted within a range between 0.005 to 1.5%.

In addition to the elements described above, one or more elements selected from (i) Cu, Ni, Cr, and Mo, one or more elements selected from (ii) Nb, V, and Ti, and (iii) B may be contained.

Cu: 0 to 1.5%

Ni: 0 to 10.0%

Cr: 0 to 10.0%

Mo: 0 to 1.5%

Cu (copper), Ni (nickel), Cr (chromium), and Mo (molybdenum) all have effects of improving hardenability of steel and improving strength of steel. Therefore, they may be contained as necessary. However, if Cu or Mo is contained at more than 1.5%, or if Ni or Cr is contained at more than 10.0%, toughness and workability of steel decrease. Therefore, a content of Cu is preferably set at 1.5% or less. A content of Ni is preferably set at 10.0% or less. A content of Cr is preferably set at 10.0% or less. A content of Mo is preferably set at 1.5% or less.

On the other hand, in order to obtain the advantageous effect of improving strength reliably, the content of Cu is preferably set at 0.1% or more. Similarly, the content of Ni is preferably set at 0.1% or more. Similarly, the content of Cr is preferably set at 0.1% or more. Similarly, the content of Mo is preferably set at 0.05% or more.

Nb: 0 to 0.1%

V: 0 to 0.3%

Ti: 0 to 0.25%

Nb (niobium), V (vanadium), and Ti (titanium) all have an effect of improving strength of steel by their precipitation strengthening. Therefore, they may be contained as necessary. However, if Nb is contained at more than 0.1%, if V is contained at more than 0.3%, or if Ti is contained at more than 0.25%, toughness of steel decreases. A content of Nb is therefore preferably set at 0.1% or less. A content of V is preferably set at 0.3% or less. A content of Ti is preferably set at 0.25% or less. On the other hand, in order to obtain the advantageous effect of improving strength reliably, the content of Nb is preferably set at 0.005% or more. The content of V is preferably set at 0.005% or more. The content of Ti is preferably set at 0.001% or more.

B: 0 to 0.005%

B (boron) has effects of improving hardenability of steel and increasing strength of steel. Therefore, it may be contained as necessary. However, if B is contained at more than 0.005%, precipitates of B can increase, resulting in decrease in toughness of steel. A content of B is therefore preferably set at 0.005% or less. On the other hand, in order to obtain the advantageous effect of improving strength of steel reliably, the content of B is preferably set at 0.0005% or more.

REM: 0.00001 to 0.0020%

If a content of REM (rare earth metal) in steel is less than 0.00001%, the effect of preventing alumina particles from clustering together cannot be obtained. The content of REM is therefore preferably set at 0.00001% or more. However, if the content of REM is more than 0.0020%, coarse clusters made of complex oxide of REM oxide and $Al_2O_3$ can be produced. Moreover, REM reacts with slag to produce complex oxide in a large quantity, degrading cleanliness of the molten steel, which can cause a blockage of an immersion nozzle of a tundish. The content of REM is therefore preferably set at 0.0020% or less, more preferably 0.0015% or less.

T.O: 0.0005 to 0.0050%

In the present disclosure, regarding a content of O (oxygen), a sum of an amount of dissolved O (sol.O), which has an influence on material quality, and an amount of O present in inclusions (insol.O), a total content of oxygen, is defined as T.O (Total.O). If a content of T.O in steel is less than 0.0005%, a time taken for secondary refining, for example, a process performed in a vacuum degasser, significantly increases, resulting in decrease in economic efficiency. The content of T.O is therefore preferably set at 0.0005% or more.

In contrast, if the content of T.O is more than 0.0050%, collisions of alumina particles increase, which may coarsen clusters. Moreover, the content of T.O being more than 0.0050% increases REM required to reform alumina, resulting in decrease in economic efficiency. The content of T.O is therefore preferably set at 0.0050% or less.

In the chemical composition according to the present disclosure, the balance is Fe and impurities. The term "impurities" as used herein means components that are mixed in steel in producing the steel industrially due to raw materials such as ores and scraps, and various factors of a producing process, and are allowed to be mixed in the steel within ranges in which the impurities have no adverse effect on the present 6. Maximum Diameter and Number of Alumina Clusters 6-1. Maximum Diameter of Alumina Clusters In the steel produced by the producing method according to the present disclosure, the formation of alumina clusters is prevented or reduced. Accordingly, a maximum diameter of the alumina clusters in the steel (killed steel) is preferably 100 μm or less. This is because, if the maximum diameter of alumina clusters is more than 100 μm, the formation of alumina clusters cannot be prevented or reduced, resulting in occurrence of surface flaws, a poor material quality, defects of a steel material. The maximum diameter of the alumina clusters in the steel (killed steel) is more preferably 60 μm or less, still more preferably 40 μm or less. The smaller the maximum diameter of alumina clusters is, the more preferably it is.

6-2. Number of Alumina Clusters

Numbers of alumina clusters being 20 μm or more per unit mass are preferably 2.0 cluster/kg or less. This is because, if the numbers of alumina clusters being 20 μm or more per unit mass exceeds 2.0 clusters/kg, surface flaws, a poor material quality, defects of a steel material occur. The numbers of alumina clusters being 20 μm or more per unit mass are more preferably 1.0 clusters/kg or less, still more preferably 0.1 clusters/kg or less.

6-3. Method of Measuring Maximum Diameter and Number of Alumina Clusters

The maximum diameter of alumina clusters can be measured by the following procedure. Specifically, from a cast piece of obtained steel (killed steel), a specimen having a mass of 1 kg is cut out, the specimen is subjected to slime electrowinning (using a minimum mesh of 20 μm), and resultant inclusions are observed under a stereoscopic microscope. The slime electrowinning may be any method that can extract alumina clusters as they are present in the steel; as an example, the method can be carried out by constant-current electrolysis under conditions such that the constant-current electrolysis is performed in 10% ferrous chloride solution at 10 A for 5 days.

The condition is not limited to this; for example, steel to which artificial spherical alumina particles of which diameters are known in advance are intentionally added is prepared, and the steel is subjected to electrowinning, and as long as a result of the electrowinning shows there are no errors of more than 10% in diameter of the alumina particles, it can be said that this is suitable for the management according to the present disclosure. Subsequently, an average value of a major axis and minor axis is determined for all inclusions extracted on a maximum mesh, and a maximum value of the average values is regarded as a maximum diameter of the inclusions, by which a maximum diameter of the cluster is measured. For this reason, the alumina clusters to be measured may include, for example, a trace amount of oxide other than alumina.

The numbers of the alumina clusters having diameters of 20 μm or more are measured by the following method. Specifically, as the above, a specimen having a mass of 1 kg is cut out from the cast piece, and the specimen is subjected to the slime electrowinning. In the slime electrowinning, a minimum mesh set at 20 μm is used, and numbers of all inclusions observed being 20 μm or more under a stereoscopic microscope are converted to that per kilogram, by which the measurement is performed.

The present disclosure will be described below more specifically with reference to Examples, but the present disclosure is not limited to these Examples.

EXAMPLE

Molten steel was controlled to have a predetermined concentration of carbon in a 270-ton converter and tapped into a ladle. When or after the tapping of the molten steel, predetermined amounts of the first group of alloys ware added. The tapped molten steel is deoxidized in an RH vacuum degasser using Al or the like as deoxidizer. The second group of alloys ware added to the deoxidized molten steel. After the addition of the second group of alloys, REM was added to the molten steel, by which steel was melted. REM was added in a form of an alloy containing Ce, La, and misch metal (e.g., REM alloy of Ce: 45%, La: 35%, Pr: 6%, Nd: 9%, and impurities), or an alloy containing misch metal, Si, and Fe (Fe—Si-30% REM).

Table 1 shows contents of the metals for component control in the alloys used as the first group of alloys and the second group of alloys, and concentrations of oxygen of the alloys. In Table 1, Content of metallic material indicates contents of the ferroalloys and the like and the metallic materials for component control as listed items. For example, for the manganese metal, the titanium metal, the copper metal, and the nickel metal, the alloy compositions indicate the contents of Mn, Ti, Cu, and Ni, respectively, and for the ferroalloys, the alloy compositions indicate the contents of Si, Mn, P, S, and the like, excluding Fe.

TABLE 1

| Category | Alloy composition (mass %) | | | | | | | | | | | | |
|---|---|---|---|---|---|---|---|---|---|---|---|---|---|
| | FeSi | Manganese metal | FeMn | FeP | FeS | Titanium metal | FeTi | FeB | FeCr | FeMo | Copper metal | Nickel metal | FeNb |
| Content of metallic material | 75 | 99.5 | 75 | 19 | 50 | 99.8 | 70 | 19 | 64 | 63 | 99.96 | 99.99 | 64 |
| Concentration of oxygen | 0.36 | 0.49 | 0.35 | 1.51 | 6.54 | 0.2 | 1.3 | 0.37 | 0.13 | 0.008 | 0.0372 | 0.0017 | 0.031 |

Table 2 shows amounts of dissolved oxygen before the addition of the first group of alloys, namely, before the addition of the first group of alloys before and after the deoxidation, kinds of the first group of alloys and kinds of the second group of alloys, as well as the amounts of oxygen introduced from the first group of alloys and the amounts of oxygen introduced from the second group of alloys, and the like.

Here, the amounts of dissolved oxygen are measured by immersing a solid electrolyte sensor in the molten steel, but this method is not limitative; it is considered that, for example, the same value is obtained by subtracting a concentration of oxygen in alumina and the like from a total concentration of oxygen resulting from a chemical analysis of a sample extracted from the molten steel.

Here, the amounts of oxygen introduced from the first group of alloys ware calculated by the following procedure. Specifically, an amount of oxygen introduced from specific alloy added before the deoxidation (mass %) was determined by Amount of added alloy (kg)×Concentration of oxygen in alloy (mass %)/Amount of molten steel (kg). According to the calculating formula, values of all amounts of oxygen introduced from each alloys added before the deoxidation were calculated, and the values were summed up, by which the amounts of oxygen introduced from the first group of alloys ware calculated.

Similarly, the amounts of oxygen introduced from the second group of alloys ware calculated by the following procedure. Specifically, an amount of oxygen introduced from specific alloy added after the deoxidation (mass %) was determined by Amount of added alloy (kg)×Concentration of oxygen in alloy (mass %)/Amount of molten steel (kg). According to the calculating formula, values of amounts of oxygen introduced from the alloys added after the deoxidation were calculated, and the values were summed up, by which the amounts of oxygen introduced from the second group of alloys ware calculated.

TABLE 2

| No. | Steel type | Before deoxidation Dissolved oxygen (%) | Types of the added alloys: First group of alloys | Types of the added alloys: Second group of alloys | Introduced oxygen: Amounts of oxygen introduced from the first alloys $O_b$ (%) | Introduced oxygen: Amounts of oxygen introduced from the second alloys $O_a$ (%) | Introduced oxygen: Ratio ($O_b/O_a$) | Introduced oxygen: Sum of amounts of oxygen introduced from the first alloys and the second alloys ($O_b - O_a$) (%) | Category |
|---|---|---|---|---|---|---|---|---|---|
| A1 | Sheet | 0.0451 | FeMn, FeP | FeTi | 0.00221 | 0.00011 | 19.9 | 0.00232 | Inventive Example |
| A2 | Sheet | 0.0371 | FeMn, FeP | FeTi | 0.00399 | 0.00019 | 21.5 | 0.00417 | |
| A3 | Sheet | 0.0358 | FeMn, FeP | FeTi | 0.00213 | 0.00022 | 9.5 | 0.00235 | |
| A4 | Sheet | 0.0324 | Manganese metal, FeS | FeTi | 0.00133 | 0.00019 | 7.1 | 0.00151 | |
| A5 | Sheet | 0.0343 | Manganese metal, FeP, FeTi | FeTi | 0.00182 | 0.00037 | 4.9 | 0.00219 | |
| A6 | Sheet | 0.0388 | Manganese metal, FeP | Titanium metal | 0.00341 | 0.00009 | 37.9 | 0.00350 | |
| A7 | Sheet | 0.0343 | Manganese metal, FeP, FeS | FeTi | 0.00607 | 0.00006 | 109.0 | 0.00613 | |
| A8 | Sheet | 0.0344 | Manganese metal, FeP | Manganese metal | 0.00225 | 0.00039 | 5.8 | 0.00265 | |
| A9 | Sheet | 0.0355 | Manganese metal, FeP | Manganese metal | 0.00415 | 0.00049 | 8.5 | 0.00464 | |
| A10 | Sheet | 0.0298 | Manganese metal, FeP, FeS | Manganese metal | 0.00277 | 0.00025 | 11.3 | 0.00302 | |
| A11 | Sheet | 0.0307 | Manganese metal, FeS | Manganese metal | 0.00230 | 0.00002 | 93.7 | 0.00232 | |
| A12 | Sheet | 0.0298 | FeMn, FeP | FeMn | 0.00278 | 0.00014 | 19.9 | 0.00292 | |
| A13 | Sheet | 0.0292 | FeMn, FeP, FeS | FeMn | 0.00479 | 0.00047 | 10.3 | 0.00526 | |
| A14 | Sheet | 0.0267 | FeMn | FeMn | 0.00322 | 0.00037 | 8.6 | 0.00359 | |
| A15 | Sheet | 0.0251 | FeMn, FeP | FeMn | 0.00120 | 0.00047 | 2.6 | 0.00166 | |
| A16 | Sheet | 0.0246 | Manganese metal, FeP | Manganese metal | 0.00327 | 0.00025 | 13.4 | 0.00352 | |
| A17 | Sheet | 0.0291 | Manganese metal | Manganese metal | 0.00196 | 0.00034 | 5.7 | 0.00230 | |
| A18 | Sheet | 0.0215 | FeSi, Manganese metal | FeSi, Manganese metal, Titanium metal | 0.01324 | 0.00046 | 29.0 | 0.01370 | |
| A19 | Plate | 0.0207 | FeSi, FeMn, FeCr | FeSi | 0.00642 | 0.00024 | 26.7 | 0.00666 | |
| A20 | Plate | 0.0270 | FeSi, FeMn, FeCr | FeSi, FeMn | 0.00608 | 0.00047 | 12.8 | 0.00656 | |
| A21 | Plate | 0.0243 | FeSi, FeMn, FeCr | FeSi, FeMn | 0.01459 | 0.00043 | 34.2 | 0.01501 | |
| A22 | Plate | 0.0173 | FeSi, FeMn, Copper metal, Nickel metal, FeCr, FeMo, FeB | FeSi, FeMn | 0.00490 | 0.00049 | 10.0 | 0.00538 | |

TABLE 2-continued

| No. | Steel type | Before deoxidation Dissolved oxygen (%) | Types of the added alloys: First group of alloys | Types of the added alloys: Second group of alloys | Introduced oxygen: Amounts of oxygen introduced from the first alloys $O_b$ (%) | Introduced oxygen: Amounts of oxygen introduced from the second alloys $O_a$ (%) | Introduced oxygen: Ratio ($O_b/O_a$) | Introduced oxygen: Sum of amounts of oxygen introduced from the first alloys and the second alloys ($O_b - O_a$) (%) | Category |
|---|---|---|---|---|---|---|---|---|---|
| A23 | Plate | 0.0145 | FeSi, Manganese metal, Nickel metal | FeSi, Manganese metal | 0.00278 | 0.00039 | 7.2 | 0.00317 | |
| A24 | Plate | 0.0197 | FeMn | FeMo, FeNb | 0.00489 | 0.00004 | 125.2 | 0.00493 | |
| A25 | Plate | 0.0167 | FeSi, FeMn, FeP, Copper metal, Nickel metal, FeCr | FeSi | 0.01592 | 0.00048 | 33.2 | 0.01640 | |
| A26 | Pipe | 0.0123 | FeSi, Manganese metal, FeS | FeSi, Manganese metal, Titanium metal | 0.00665 | 0.00037 | 18.0 | 0.00702 | |
| A27 | Pipe | 0.0078 | Manganese metal, FeS | Manganese metal, Titanium metal | 0.01100 | 0.00024 | 46.4 | 0.01123 | |
| A28 | Pipe | 0.0063 | FeSi, Manganese metal, FeS, Titanium metal | FeSi, Manganese metal, Titanium metal | 0.00368 | 0.00049 | 7.5 | 0.00417 | |
| A29 | Pipe | 0.0108 | FeSi, Manganese metal, FeS | FeSi, Titanium metal | 0.00459 | 0.00046 | 9.9 | 0.00505 | |
| A30 | Pipe | 0.0103 | FeSi, Manganese metal, FeS | FeSi, Titanium metal | 0.00683 | 0.00028 | 24.1 | 0.00711 | |
| A31 | Pipe | 0.0054 | FeSi, Manganese metal, FeS | FeSi, Manganese metal, Titanium metal | 0.00842 | 0.00037 | 23.0 | 0.00878 | |

Table 3 shows the same items as in Table 2. The measurement for the items was performed by the same procedure. Here, in examples shown in Table 3, the amount of dissolved oxygen in the molten steel was 0.0050 mass % or more before the deoxidation. Table 3 shows amounts of dissolved oxygen after the deoxidation for reference purposes.

TABLE 3

| No. | Steel type | After deoxidation Dissolved oxygen (%) | Types of the added alloys: First group of alloys | Types of the added alloys: Second group of alloys | Introduced oxygen: Amounts of oxygen introduced from the first alloys $O_b$ (%) | Introduced oxygen: Amounts of oxygen introduced from the second alloys $O_a$ (%) | Introduced oxygen: Ratio ($O_b/O_a$) | Introduced oxygen: Sum of amounts of oxygen introduced from the first alloys and the second alloys ($O_b + O_a$) (%) | Category |
|---|---|---|---|---|---|---|---|---|---|
| B1 | Sheet | 0.0011 | FeP, FeS | Manganese metal, FeP, FeS, FeTi | 0.0012 | 0.00157 | 0.8 | 0.00277 | Comparative Example |
| B2 | Sheet | 0.0012 | FeP | Manganese metal, FeP, FeTi | 0.00032 | 0.00210 | 0.2 | 0.00242 | |
| B3 | Sheet | 0.0009 | FeP | Manganese metal, FeP, FeTi | 0.00183 | 0.00381 | 0.5 | 0.00563 | |
| B4 | Sheet | 0.0010 | FeP, FeS | Manganese metal, FeP, FeS, FeTi | 0.00089 | 0.00385 | 0.2 | 0.00385 | |
| B5 | Sheet | 0.0010 | FeSi, FeMn | FeSi, FeMn, FeTi | 0.00095 | 0.01278 | 0.1 | 0.01278 | |
| B6 | Plate | 0.0013 | — | FeSi, FeMn, FeCr | 0 | 0.00657 | 0 | 0.00657 | |
| B7 | Plate | 0.0017 | — | FeSi, FeMn, FeCr | 0 | 0.00642 | 0 | 0.00642 | |
| B8 | Plate | 0.0015 | — | FeSi, FeMn, FeCr | 0 | 0.00629 | 0 | 0.00629 | |
| B9 | Plate | 0.0008 | Copper metal, Nickel metal | FeSi, FeMn, FeCr, FeMo, FeB | 0.00008 | 0.00518 | 0.02 | 0.00526 | |
| B10 | Plate | 0.0012 | Nickel metal | FeSi, Manganese metal | 0.00016 | 0.00314 | 0.1 | 0.00329 | |
| B11 | Plate | 0.0012 | FeMn | FeMn, FeMo, FeNb | 0.00047 | 0.00494 | 0.1 | 0.00541 | |
| B12 | Plate | 0.0019 | Copper metal, Nickel metal | FeSi, FeMn, FeP, FeCr | 0.00011 | 0.01560 | 0.007 | 0.01571 | |
| B13 | Pipe | 0.0034 | FeS | FeSi, FeS, Titanium metal | 0.00039 | 0.00189 | 0.2 | 0.00229 | |
| B14 | Pipc | 0.0009 | FeS | FeSi, Manganese metal, FeS, Titanium metal | 0.00026 | 0.00196 | 0.1 | 0.00222 | |

TABLE 3-continued

| No. | Steel type | After deoxidation Dissolved oxygen (%) | Types of the added alloys: First group of alloys | Types of the added alloys: Second group of alloys | Introduced oxygen: Amounts of oxygen introduced from the first alloys $O_b$ (%) | Introduced oxygen: Amounts of oxygen introduced from the second alloys $O_a$ (%) | Introduced oxygen: Ratio ($O_b/O_a$) | Introduced oxygen: Sum of amounts of oxygen introduced from the first alloys and the second alloys ($O_b + O_a$) (%) | Category |
|---|---|---|---|---|---|---|---|---|---|
| B15 | Pipe | 0.0031 | FeS | FeSi, Manganese metal, FeS, Titanium metal | 0.00065 | 0.00351 | 0.2 | 0.00417 | |
| B16 | Pipe | 0.0032 | FeS | FeSi, Manganese metal, Titanium metal | 0.00026 | 0.00638 | 0.04 | 0.00664 | |

Table 4 shows the same items as in Table 2. Table 4 shows amounts of dissolved oxygen before the deoxidation as with Table 2.

TABLE 4

| No. | Steel type | Before deoxidation Dissolved oxygen (%) | Types of the added alloys: First group of alloys | Types of the added alloys: Second group of alloys | Introduced oxygen: Amounts of oxygen introduced from the first alloys $O_b$ (%) | Introduced oxygen: Amounts of oxygen introduced from the second alloys $O_a$ (%) | Introduced oxygen: Ratio ($O_b/O_a$) | Introduced oxygen: Sum of amounts of oxygen introduced from the first alloys and the second alloys ($O_b + O_a$) (%) | Category |
|---|---|---|---|---|---|---|---|---|---|
| C1 | Sheet | 0.0451 | FeMn, FeP | FeTi | 0.00221 | 0.00011 | 19.9 | 0.00232 | Comparative Example |
| C2 | Sheet | 0.0343 | Manganese metal, FeP, FeTi | FeTi | 0.00182 | 0.00037 | 4.9 | 0.00219 | |
| C3 | Sheet | 0.0344 | Manganese metal, FeP | Manganese metal | 0.00225 | 0.00039 | 5.8 | 0.00265 | |
| C4 | Sheet | 0.0355 | Manganese metal, FeP | Manganese metal | 0.00415 | 0.00049 | 8.5 | 0.00464 | |
| C5 | Sheet | 0.0298 | Manganese metal, FeP, FeS | Manganese metal | 0.00277 | 0.00025 | 11.3 | 0.00302 | |
| C6 | Sheet | 0.0307 | Manganese metal, FeS | Manganese metal | 0.00230 | 0.00002 | 93.7 | 0.00232 | |
| C7 | Sheet | 0.0292 | FeMn, FeP, FeS | FeMn | 0.00479 | 0.00047 | 10.3 | 0.00526 | |
| C8 | Plate | 0.0207 | FeSi, FeMn, FeCr | FeSi | 0.00642 | 0.00024 | 26.7 | 0.00666 | |
| C9 | Plate | 0.0270 | FeSi, FeMn, FeCr | FeSi, FeMn | 0.00608 | 0.00047 | 12.8 | 0.00656 | |
| C10 | Plate | 0.0243 | FeSi, FeMn, FeCr | FeSi, FeMn | 0.01459 | 0.00043 | 34.2 | 0.01501 | |
| C11 | Plate | 0.0173 | FeSi, FeMn, Copper metal, Nickel metal, FeCr, FeMo, FeB | FeSi, FeMn | 0.00490 | 0.00049 | 10.0 | 0.00538 | |
| C12 | Plate | 0.0145 | FeSi, Manganese metal, Nickel metal | FeSi, Manganese metal | 0.00278 | 0.00039 | 7.2 | 0.00317 | |
| C13 | Plate | 0.0197 | FeMn | FeMo, FeNb | 0.00489 | 0.00004 | 125.2 | 0.00493 | |
| C14 | Plate | 0.0167 | FeSi, FeMn, FeP, Copper metal, Nickel metal, FeCr | FeSi | 0.01592 | 0.00048 | 33.2 | 0.01640 | |
| C15 | Pipe | 0.0078 | Manganese metal, FeS | Manganese metal, Titanium metal | 0.01100 | 0.00024 | 46.4 | 0.01123 | |
| C16 | Pipe | 0.0063 | FeSi, Manganese metal, FeS, Titanium metal | FeSi, Manganese metal, Titanium metal | 0.00368 | 0.00049 | 7.5 | 0.00417 | |
| C17 | Pipe | 0.0108 | FeSi, Manganese metal, FeS | FeSi, Titanium metal | 0.00459 | 0.00046 | 9.9 | 0.00505 | |
| C18 | Pipe | 0.0103 | FeSi, Manganese metal, FeS | FeSi, Titanium metal | 0.00683 | 0.00028 | 24.1 | 0.00711 | |
| C19 | Pipe | 0.0054 | FeSi, Manganese metal, FeS | FeSi, Manganese metal, Titanium metal | 0.00842 | 0.00037 | 23.0 | 0.00878 | |

For steels obtained under conditions shown in Table 2 to Table 4, their chemical compositions, REM/T.O, and the like were determined. In the chemical compositions, REM and T.O were calculated using analysis values from analysis performed on molten steel samples after a lapse of one minute after the addition of REM.

As described above, the melted steels were subjected to continuous casting using a vertical-bending continuous casting machine. Under casting conditions including a casting speed of 1.0 to 1.8 m/min, a molten steel temperature in tundish of 1520 to 1580° C., continuous casting cast pieces being 245 mm thick×1200 to 2200 mm wide were produced. At this time, a blockage condition of an immersion nozzle was also checked.

Specifically, after the continuous casting, adhesion thicknesses of inclusions on an inner wall of the immersion nozzle was measured at 10 spots in a circumferential direction, and from an average value of the adhesion thicknesses, the nozzle blockage condition was rated as follows. Cases where the adhesion thickness was less than 1 mm were evaluated to be free from nozzle blockage and shown as ○ in Tables. Cases where the adhesion thickness ranged between 1 to 5 mm were evaluated to have slight nozzle blockage and shown as Δ in Tables. Cases where the adhesion thickness was more than 5 mm were evaluated to have nozzle blockage and shown as x in Tables.

The maximum alumina cluster diameter and the numbers of alumina clusters being 20 μm or more per unit mass were also measured using the obtained cast pieces by the following procedure.

From a cast piece of the obtained steel (killed steel), a specimen having a mass of 1 kg was cut out, the specimen was subjected to slime electrowinning (using a minimum mesh of 20 μm), and resultant inclusions were observed under a stereoscopic microscope. The slime electrowinning was performed under conditions such that the constant-current electrolysis was performed in 10% ferrous chloride solution at 10 A for 5 days to perform the test. The observation was conducted at 400× magnification. For this reason, the alumina clusters to be measured may include, for example, a trace amount of oxide other than alumina.

The numbers of the alumina clusters having diameters of 20 μm or more ware measured by the following method. Specifically, as the above, a specimen having a mass of 1 kg was cut out from the cast piece, and the specimen was subjected to the slime electrowinning. In the slime electrowinning, a minimum mesh set at 20 μm was used, and numbers of all inclusions observed being 20 μm or more under a stereoscopic microscope ware converted to that per kilogram, by which the measurement was performed. The observation was conducted at 100× magnification.

Thereafter, the resultant cast pieces were (a) subjected to hot rolling and pickling to be produced into thick plates, (b) subjected to hot rolling, pickling, and cold rolling to be produced into sheets, or (c) subjected to hot rolling and pickling to be produced into thick plates, which were used as starting materials and produced into welded steel pipes. A plate thickness after the hot rolling was set at 2 to 100 mm, and a sheet thickness after the cold rolling was set at 0.2 to 1.8 mm.

For the resultant steel materials (sheets, thick plates, or pipes), rate of defect occurrence, impact energy absorption, and reduction of area in thickness direction were measured. The rate of defect occurrence was calculated for each of kinds of the steel materials. That is, in a case of the sheets, a rate of sliver defect occurrence on a sheet surface (=Total length of sliver defects/Coil length×100, %) was calculated, and the calculated value was used as the rate of defect occurrence. The sliver defects refer to linear flaws formed on a surface, and cases where the rate of sliver defect occurrence was 0.15% or less were evaluated to be good in material quality.

In a case of the thick plates, a rate of UST defect occurrence or a rate of separation occurrence of product plates (=Number of plates with defect occurrence/Total number of tested plates×100, %) was calculated, and the calculated value was used as the rate of defect occurrence. In a case of the pipes, a rate of UST defect occurrence in a welded zone of oil well pipes (=Number of pipes with defect occurrence/Total number of tested pipes×100, %) was calculated, and the calculated value was used as the rate of defect occurrence.

Here, the UST defect refers to inner defect that is detected with an ultrasonic testing apparatus, and cases where the rate of UST defect occurrence was 3.0% or less were evaluated to be good in material quality. The separation refers to delamination, which is observed on a fracture surface of a specimen after the Charpy test, and cases where the rate of separation occurrence was 6.0% or less were evaluated to be good in material quality. In Tables, cases where the occurring defect was the UST defect were shown as UST, and cases where the occurring defect was the separation were shown as SPR.

Regarding the UST defect, the evaluation was made by using a UST apparatus. As the UST apparatus, an A-scope presentation flaw detector including a normal beam testing probe with a transducer having a diameter of 25 mm and a nominal frequency of 2 MHz was used. In a case of a thick plate, the evaluation was made according to JIS G 0801, and cases rated as flaw displaying symbol Δ were evaluated as the defect occurrence, and in a case of a pipe weld zone, the evaluation was made according to JIS G 0584, and cases that reach an acceptance/reject level as compared with a reference sample with a reference standard categorized into Category UX were evaluated as the defect occurrence. Regarding the separation, a fracture surface of a specimen was observed after the Charpy test to be described below to check for separation.

The Charpy test was conducted in conformity to JIS Z 2242:2018, and the test was conducted such that a V notch having a width of 10 mm was introduced onto the specimen in a rolling direction. A test temperature was −20° ° C., an average value of impact values of five specimens was used as the impact energy absorption.

In a case of a thick plate, the tensile test was also conducted, and a reduction of area in a plate-thickness direction was calculated. The tensile test was performed in conformity with JIS Z 2241:2011. Note that the reduction of area in the plate-thickness direction is calculated as (Cross-sectional area of ruptured area after the tensile test/Cross-sectional area of specimen before the test×100, %).

Obtained results are collectively shown in Tables 5 to 7.

TABLE 5

| | Steel | Chemical composition of steel(mass %, balance: Fe and impurities) | | | | | | | | |
|---|---|---|---|---|---|---|---|---|---|---|
| No. | type | C | Si | Mn | P | S | T.Al | Optional elements | REM | T.O |
| A1 | Sheet | 0.0005 | 0.035 | 0.55 | 0.017 | 0.0057 | 0.05 | Ti: 0.006 | 0.0003 | 0.0027 |
| A2 | Sheet | 0.002 | 0.005 | 0.76 | 0.027 | 0.0114 | 0.02 | Ti: 0.01 | 0.0002 | 0.0020 |
| A3 | Sheet | 0.004 | 0.011 | 0.14 | 0.04 | 0.0171 | 0.07 | Ti: 0.012 | 0.0005 | 0.0035 |
| A4 | Sheet | 0.007 | 0.019 | 0.33 | 0.007 | 0.0219 | 0.034 | Ti: 0.01 | 0.0005 | 0.0021 |
| A5 | Sheet | 0.002 | 0.013 | 0.36 | 0.019 | 0.0133 | 0.066 | Ti: 0.035 | 0.0006 | 0.0025 |
| A6 | Sheet | 0.004 | 0.018 | 0.53 | 0.032 | 0.019 | 0.035 | Ti: 0.045 | 0.0010 | 0.0033 |
| A7 | Sheet | 0.006 | 0.032 | 0.81 | 0.042 | 0.0238 | 0.015 | Ti: 0.003 | 0.0021 | 0.0042 |
| A8 | Sheet | 0.019 | 0.077 | 0.65 | 0.015 | 0.0038 | 0.055 | — | 0.0003 | 0.0025 |
| A9 | Sheet | 0.038 | 0.006 | 0.91 | 0.024 | 0.0105 | 0.03 | — | 0.0004 | 0.0018 |
| A10 | Sheet | 0.067 | 0.03 | 0.15 | 0.038 | 0.0276 | 0.09 | — | 0.0002 | 0.0017 |

TABLE 5-continued

| | | | | | | | | | | |
|---|---|---|---|---|---|---|---|---|---|---|
| A11 | Sheet | 0.096 | 0.053 | 0.45 | 0.005 | 0.025 | 0.032 | — | 0.0002 | 0.0022 |
| A12 | Sheet | 0.048 | 0.038 | 0.43 | 0.033 | 0.0181 | 0.066 | — | 0.0002 | 0.0015 |
| A13 | Sheet | 0.124 | 0.057 | 0.69 | 0.044 | 0.0219 | 0.058 | — | 0.0004 | 0.0018 |
| A14 | Sheet | 0.01 | 0.084 | 0.88 | 0.006 | 0.0057 | 0.066 | — | 0.0003 | 0.0014 |
| A15 | Sheet | 0.007 | 0.013 | 0.16 | 0.033 | 0.0143 | 0.087 | — | 0.0005 | 0.0019 |
| A16 | Sheet | 0.029 | 0.038 | 0.39 | 0.042 | 0.0067 | 0.075 | — | 0.0005 | 0.0016 |
| A17 | Shect | 0.019 | 0.075 | 0.58 | 0.013 | 0.006 | 0.034 | — | 0.0016 | 0.0033 |
| A18 | Sheet | 0.15 | 0.5 | 2.5 | 0.01 | 0.003 | 0.035 | Ti: 0.035 | 0.0008 | 0.0024 |
| A19 | Plate | 0.28 | 0.29 | 1.08 | 0.011 | 0.003 | 0.005 | Cr: 0.6 | 0.0002 | 0.0019 |
| A20 | Plate | 0.27 | 0.3 | 1.1 | 0.01 | 0.004 | 0.013 | Cr: 0.48 | 0.0002 | 0.0020 |
| A21 | Plate | 0.3 | 0.68 | 2.53 | 0.009 | 0.005 | 1.2 | Cr: 0.46 | 0.0003 | 0.0015 |
| A22 | Plate | 0.11 | 0.25 | 0.9 | 0.01 | 0.005 | 0.065 | Cu: 0.2, Ni: 0.85, Cr: 0.45 Mo: 0.35, V: 0.04, B: 0.001 | 0.0002 | 0.0009 |
| A23 | Plate | 0.06 | 0.25 | 0.61 | 0.012 | 0.004 | 0.04 | Xi: 9.25 | 0.0004 | 0.0012 |
| A24 | Plate | 0.07 | 0.05 | 1.2 | 0.008 | 0.0005 | 0.03 | Mo: 0.25, Nb: 0.015, V: 0.025 | 0.0007 | 0.0014 |
| A25 | Plate | 0.08 | 0.45 | 0.45 | 0.17 | 0.005 | 0.015 | Cu: 0.28, Ni: 0.15, Cr: 0.4 | 0.0009 | 0.0023 |
| A26 | Pipe | 0.513 | 0.36 | 1.18 | 0.008 | 0.0238 | 0.008 | Ti: 0.015 | 0.0004 | 0.0012 |
| A27 | Pipe | 0.551 | 0.019 | 1.69 | 0.01 | 0.046 | 0.009 | Ti: 0.045 | 0.0005 | 0.0013 |
| A28 | Pipe | 0.589 | 0.135 | 0.13 | 0.014 | 0.046 | 0.006 | Ti: 0.25 | 0.0011 | 0.0035 |
| A29 | Pipe | 0.618 | 0.252 | 0.66 | 0.004 | 0.03 | 0.006 | Ti: 0.16 | 0.0013 | 0.0028 |
| A30 | Pipe | 0.561 | 0.153 | 0.67 | 0.005 | 0.05 | 0.008 | Ti: 0.07 | 0.0017 | 0.0042 |
| A31 | Pipe | 0.58 | 0.243 | 1.24 | 0.011 | 0.039 | 0.005 | Ti: 0.038 | 0.0016 | 0.0036 |

| | | | Clusters | | Rate of | Impact | Reduction of area | | |
|---|---|---|---|---|---|---|---|---|---|
| No. | REM/T.O | Types of added REM | Maximum diameter (μm) | Numers (Clusters/kg) | defect occurrence (%) | energy absorption (J) | in a plate-thickness direction (%) | Blockage condition of the nozzle | Category |
| A1 | 0.111 | Misch metal-Si alloy | 62 | 0.1 | 0.12 | | | ○ | Inventive Example |
| A2 | 0.100 | Misch metal-Si alloy | 55 | 0.2 | 0.07 | | | ○ | |
| A3 | 0.143 | Misch metal-Si alloy | 28 | 0.1 | 0.05 | | | ○ | |
| A4 | 0.238 | Misch metal-Si alloy | <20 | 0.0 | 0.14 | | | ○ | |
| A5 | 0.240 | Misch metal | <20 | 0.0 | 0.11 | | | ○ | |
| A6 | 0.303 | Misch metal-Si alloy | <20 | 0.0 | 0.13 | | | ○ | |
| A7 | 0.500 | Ce | 43 | 0.6 | 0.15 | | | ○ | |
| A8 | 0.120 | Misch metal-Si alloy | 54.5 | 0.1 | 0.14 | | | ○ | |
| A9 | 0.222 | Misch metal-Si alloy | <20 | 0.0 | 0.15 | | | ○ | |
| A10 | 0.118 | Misch metal-Si alloy | 46.5 | 0.4 | 0.13 | | | ○ | |
| A11 | 0.091 | Misch metal-Si alloy | 75 | 0.1 | 0.12 | | | ○ | |
| A12 | 0.133 | Misch metal-Si alloy | 31.5 | 0.2 | 0.09 | | | ○ | |
| A13 | 0.222 | Misch metal-Si alloy | <20 | 0.0 | 0.07 | | | ○ | |
| A14 | 0.214 | Misch metal | <20 | 0.0 | 0.07 | | | ○ | |
| A15 | 0.263 | Misch metal-Si alloy | <20 | 0.0 | 0.10 | | | ○ | |
| A16 | 0.313 | Misch metal-Si alloy | <20 | 0.0 | 0.05 | | | ○ | |
| A17 | 0.485 | La | 52 | 0.2 | 0.07 | | | ○ | |
| A18 | 0.333 | Misch metal-Si alloy | <20 | 0.0 | 0.07 | | | ○ | |
| A19 | 0.105 | Misch metal-Si alloy | 36 | 0.4 | | 47.76 | | ○ | |
| A20 | 0.100 | Misch metal-Si alloy | 29 | 0.1 | | 48.24 | | ○ | |
| A21 | 0.200 | Misch metal-Si alloy | <20 | 0.0 | | 43.8 | | ○ | |
| A22 | 0.222 | Misch metal-Si alloy | <20 | 0.0 | 2.6(UST) | | | ○ | |
| A23 | 0.333 | Misch metal | <20 | 0.0 | 5.4(SPR) | | | ○ | |
| A24 | 0.500 | La | 84 | 1.8 | | | 83.7 | ○ | |
| A25 | 0.391 | Misch metal-Si alloy | <20 | 0.0 | | | 86.9 | ○ | |
| A26 | 0.333 | Misch metal-Si alloy | <20 | 0.0 | 0.03 | | | ○ | |
| A27 | 0.385 | Misch metal-Si alloy | <20 | 0.0 | 0.02 | | | ○ | |
| A28 | 0.314 | Misch metal-Si alloy | <20 | 0.0 | 0.12 | | | ○ | |
| A29 | 0.464 | Misch metal | 58 | 0.1 | 0.06 | | | ○ | |
| A30 | 0.405 | Misch metal-Si alloy | <20 | 0.0 | 0.12 | | | ○ | |
| A31 | 0.444 | Ce | 37 | 0.1 | 0.12 | | | ○ | |

TABLE 6

| | Steel | Chemical composition of steel(mass %, balance: Fe and impurities) | | | | | | | | |
|---|---|---|---|---|---|---|---|---|---|---|
| No. | type | C | Si | Mn | P | S | T.Al | Optional elements | REM | T.O |
| B1 | Sheet | 0.0005 | 0.011 | 0.14 | 0.027 | 0.0219 | 0.05 | Ti: 0.012 | 0.0003 | 0.0014 |
| B2 | Sheet | 0.002 | 0.013 | 0.36 | 0.019 | 0.0133 | 0.03 | Ti: 0.03 | 0.0005 | 0.0019 |
| B3 | Sheet | 0.038 | 0.053 | 0.4 | 0.038 | 0.0124 | 0.08 | Ti: 0.045 | 0.0005 | 0.0016 |
| B4 | Sheet | 0.002 | 0.025 | 0.6 | 0.02 | 0.0238 | 0.032 | Ti: 0.03 | 0.0016 | 0.0033 |
| B5 | Sheet | 0.27 | 0.5 | 2.5 | 0.01 | 0.003 | 0.035 | Ti: 0.035 | 0.0008 | 0.0024 |

TABLE 6-continued

| | | | | | | | | | | |
|---|---|---|---|---|---|---|---|---|---|---|
| B6 | Plate | 0.27 | 0.28 | 1.11 | 0.008 | 0.005 | 0.028 | Cr: 0.51 | 0.0002 | 0.0019 |
| B7 | Plate | 0.29 | 0.31 | 1.06 | 0.012 | 0.004 | 0.015 | Cr: 0.48 | 0.0002 | 0.0020 |
| B8 | Plate | 0.31 | 0.27 | 1.07 | 0.01 | 0.003 | 0.022 | Cr: 0.49 | 0.0003 | 0.0015 |
| B9 | Plate | 0.1 | 0.23 | 0.88 | 0.008 | 0.005 | 0.062 | Cu: 0.18, Ni: 0.83, Cr: 0.44 Mo: 0.32, V: 0.03, B: 0.0015 | 0.0002 | 0.0009 |
| B10 | Plate | 0.055 | 0.59 | 0.27 | 0.012 | 0.004 | 0.035 | Ni: 9.33 | 0.0004 | 0.0012 |
| B11 | Plate | 0.072 | 0.052 | 1.26 | 0.01 | 0.003 | 0.022 | Mo: 0.25, Nb: 0.015, V: 0.025 | 0.0007 | 0.0014 |
| B12 | Plate | 0.08 | 0.45 | 0.45 | 0.16 | 0.005 | 0.015 | Cu: 0.28, Ni: 0.15, Cr: 0.4 | 0.0009 | 0.0023 |
| B13 | Pipe | 0.562 | 0.145 | 0.11 | 0.012 | 0.034 | 0.006 | Ti: 0.12 | 0.0004 | 0.0012 |
| B14 | Pipe | 0.48 | 0.37 | 0.19 | 0.009 | 0.0238 | 0.08 | Ti: 0.018 | 0.0005 | 0.0013 |
| B15 | Pipe | 0.589 | 0.135 | 0.13 | 0.014 | 0.046 | 0.006 | Ti: 0.25 | 0.0011 | 0.0035 |
| B16 | Pipe | 0.637 | 0.144 | 1.35 | 0.002 | 0.022 | 0.005 | Ti: 0.045 | 0.0013 | 0.0028 |

| | | | Clusters | | Rate of | Impact | Reduction of area | Blockage | |
|---|---|---|---|---|---|---|---|---|---|
| No. | REM/ T.O | Types of added REM | Maximum diameter (μm) | Numers (Clusters/ kg) | defect occurrence (%) | energy absorption (J) | in a plate-thickness direction (%) | condition of the nozzle | Category |
| B1 | 0.214 | Misch metal-Si alloy | 228 | 8.4 | 0.96 | | | Δ | Comparative Example |
| B2 | 0.263 | Misch metal | 172.5 | 1.7 | 0.72 | | | Δ | |
| B3 | 0.313 | Misch metal-Si alloy | 237 | 5.9 | 0.72 | | | X | |
| B4 | 0.485 | Ce | 348 | 5.0 | 0.84 | | | X | |
| B5 | 0.333 | Misch metal-Si alloy | 247.5 | 6.0 | 0.70 | | | X | |
| B6 | 0.105 | Misch metal | 201 | 10.2 | | 17.28 | | Δ | |
| B7 | 0.100 | Misch metal-Si alloy | 289.5 | 3.8 | | 21.2 | | Δ | |
| B8 | 0.200 | Misch metal-Si alloy | 232.5 | 7.2 | | 17.84 | | X | |
| B9 | 0.222 | La | 183 | 3.2 | 19.6(UST) | | | Δ | |
| B10 | 0.333 | Misch metal-Si alloy | 301.5 | 4.5 | 28.3(SPR) | | | X | |
| B11 | 0.500 | Misch metal-Si alloy | 378 | 8.9 | | | 34.1 | Δ | |
| B12 | 0.391 | Misch metal | 223.5 | 5.1 | | | 48.5 | Δ | |
| B13 | 0.333 | La | 249 | 8.6 | 2.04 | | | Δ | |
| B14 | 0.385 | Misch metal-Si alloy | 130 | 4.4 | 1.68 | | | X | |
| B15 | 0.314 | Misch metal-Si alloy | 228 | 5.3 | 1.92 | | | Δ | |
| B16 | 0.464 | Misch metal-Si alloy | 325.5 | 5.6 | 1.32 | | | X | |

TABLE 7

| | Steel | Chemical composition of steel(mass %, balance: Fe and impurities) | | | | | | | | |
|---|---|---|---|---|---|---|---|---|---|---|
| No. | type | C | Si | Mn | P | S | T.Al | Optional elements | REM | T.O |
| C1 | Sheet | 0.0005 | 0.035 | 0.55 | 0.017 | 0.0057 | 0.05 | Ti: 0.006 | — | 0.0035 |
| C2 | Sheet | 0.002 | 0.013 | 0.36 | 0.019 | 0.0133 | 0.066 | Ti: 0.035 | 0.0001 | 0.0028 |
| C3 | Sheet | 0.019 | 0.077 | 0.65 | 0.015 | 0.0038 | 0.055 | — | 0.0001 | 0.0033 |
| C4 | Sheet | 0.038 | 0.006 | 0.91 | 0.024 | 0.0105 | 0.03 | — | 0.0011 | 0.0021 |
| C5 | Sheet | 0.067 | 0.03 | 0.15 | 0.038 | 0.0276 | 0.09 | — | 0.0008 | 0.0013 |
| C6 | Sheet | 0.096 | 0.053 | 0.45 | 0.005 | 0.025 | 0.032 | — | 0.0012 | 0.0020 |
| C7 | Sheet | 0.124 | 0.057 | 0.69 | 0.044 | 0.0219 | 0.058 | — | — | 0.0012 |
| C8 | Plate | 0.28 | 0.29 | 1.08 | 0.011 | 0.003 | 0.005 | Cr: 0.6 | — | 0.0009 |
| C9 | Plate | 0.27 | 0.3 | 1.1 | 0.01 | 0.004 | 0.013 | Cr: 0.48 | — | 0.0015 |
| C10 | Plate | 0.3 | 0.68 | 2.53 | 0.009 | 0.005 | 1.2 | Cr: 0.46 | 0.0008 | 0.0014 |
| C11 | Plate | 0.11 | 0.25 | 0.9 | 0.01 | 0.005 | 0.065 | Cu: 0.2, Ni: 0.85, Cr: 0.45 Mo: 0.35, V: 0.04, B: 0.001 | 0.0007 | 0.0012 |
| C12 | Plate | 0.06 | 0.25 | 0.61 | 0.012 | 0.004 | 0.04 | Ni: 9.25 | — | 0.0009 |
| C13 | Plate | 0.07 | 0.05 | 1.2 | 0.008 | 0.0005 | 0.03 | Mo: 0.25, Nb: 0.015, V: 0.025 | 0.0001 | 0.0022 |
| C14 | Plate | 0.08 | 0.45 | 0.45 | 0.17 | 0.005 | 0.015 | Cu: 0.28, Ni: 0.15, Cr: 0.4 | 0.0008 | 0.0014 |
| C15 | Pipe | 0.551 | 0.019 | 1.69 | 0.01 | 0.046 | 0.009 | Ti: 0.045 | — | 0.0038 |
| C16 | Pipe | 0.589 | 0.135 | 0.13 | 0.014 | 0.046 | 0.006 | Ti: 0.25 | 0.0001 | 0.0035 |

TABLE 7-continued

| | | | | | | | | | | |
|---|---|---|---|---|---|---|---|---|---|---|
| C17 | Pipe | 0.618 | 0.252 | 0.66 | 0.004 | 0.03 | 0.006 | Ti: 0.16 | — | 0.0028 |
| C18 | Pipe | 0.561 | 0.153 | 0.67 | 0.005 | 0.0504 | 0.008 | Ti: 0.07 | 0.0001 | 0.0032 |
| C19 | Pipe | 0.58 | 0.243 | 1.24 | 0.011 | 0.039 | 0.005 | Ti: 0.038 | 0.0022 | 0.0042 |

| | | | Clusters | | Rate of | Impact | Reduction of area | Blockage | |
|---|---|---|---|---|---|---|---|---|---|
| No. | REM/ T.O | Types of added REM | Maximum diameter (μm) | Numers (Clusters/ kg) | defect occurrence (%) | energy absorption (J) | in a plate-thickness direction (%) | condition of the nozzle | Category |
| C1 | 0 | Misch metal-Si alloy | 132 | 5.6 | 0.24 | | | Δ | Comparative Example |
| C2 | 0.036 | Misch metal-Si alloy | 248 | 3.1 | 0.216 | | | Δ | |
| C3 | 0.030 | Misch metal | 290 | 3.5 | 0.276 | | | X | |
| C4 | 0.524 | Misch metal-Si alloy | 233 | 7.5 | 0.312 | | | Δ | |
| C5 | 0.615 | Ce | 283 | 4 | 0.252 | | | X | |
| C6 | 0.600 | Misch metal-Si alloy | 229 | 8.2 | 0.24 | | | Δ | |
| C7 | 0 | Misch metal | 224 | 2.8 | 0.17 | | | Δ | |
| C8 | 0 | Misch metal-Si alloy | 155 | 5.8 | | 31.84 | | Δ | |
| C9 | 0 | Misch metal-Si alloy | 181 | 2.5 | | 32.16 | | Δ | |
| C10 | 0.571 | La | 165 | 1.8 | | 29.2 | | Δ | |
| C11 | 0.583 | Misch metal-Si alloy | 145 | 3.3 | 5.5(UST) | | | Δ | |
| C12 | 0 | Misch metal-Si alloy | 195 | 2.1 | 9.9(SPR) | | | Δ | |
| C13 | 0.045 | Misch metal | 121 | 5.3 | | | 64.35 | Δ | |
| C14 | 0.571 | La | 130 | 6.3 | | | 61.1 | Δ | |
| C15 | 0 | Misch metal-Si alloy | 171 | 5.7 | 0.33 | | | Δ | |
| C16 | 0.029 | Misch metal-Si alloy | 122 | 2.9 | 0.24 | | | Δ | |
| C17 | 0 | Misch metal-Si alloy | 183 | 3.7 | 0.17 | | | Δ | |
| C18 | 0.031 | Misch metal-Si alloy | 144 | 2.4 | 0.24 | | | Δ | |
| C19 | 0.524 | Cc | 121 | 5.3 | 0.24 | | | Δ | |

In Nos. A1 to A31, which satisfied the definitions according to the present disclosure, the occurrence of alumina clusters was prevented or reduced, and the occurrence of defect was also reduced. Moreover, in Nos. A1 to A31, no nozzle blockage occurred in the continuous casting.

In contrast, in Nos. B1 to B16 and C1 to C19, which did not satisfy the definitions according to the present disclosure, coarse alumina clusters occurred, and the occurrence of defect could not be reduced. Moreover, in Nos. B1 to B16 and C1 to C19, the slight nozzle blockage or the nozzle blockage occurred in the continuous casting.

The invention claimed is:

1. A method for producing steel, comprising:

adding a first group of alloys to molten steel, wherein the molten steel has an amount of dissolved oxygen of 0.0050 mass % or more;

after the adding the first group of alloys, adding deoxidizer to the molten steel for deoxidation;

after the adding the deoxidizer, adding a second group of alloys, which includes certain amounts of oxygen, to the deoxidized molten steel; and after the adding the second group of alloys, adding REM to the molten steel, wherein amounts of oxygen introduced from the first group of alloys and amounts of oxygen introduced from the second group of alloys satisfy formulas (i) to (iii), and after the adding REM, the ratio between REM and T.O satisfies formula (iv):

$$O_a \leq 0.00100 \quad \text{(i)}$$

$$O_b + O_a \geq 0.00150 \quad \text{(ii)}$$

$$O_b / O_a \geq 2.0 \quad \text{(iii)}$$

$$0.05 \leq REM/T.O \leq 0.5 \quad \text{(iv)}$$

where symbols in the formulas are defined as follows:

$O_b$: the amounts of oxygen introduced from the first group of alloys, in mass %;

$O_a$: the amounts of oxygen introduced from the second group of alloys, in mass %;

REM: content of REM, in mass %;

T.O: total content of oxygen, in mass %.

2. The method for producing steel according to claim 1, wherein the first group of alloys and the second group of alloys are selected from the group consisting of manganese metal, titanium metal, copper metal, nickel metal, FeMn, FeP, FeTi, FeS, FeSi, FeCr, FeMo, FeB, and FeNb.

3. The method for producing steel according to claim 1, wherein a chemical composition of the steel consists of, in mass %:

C: 0.0005 to 1.5%;
Si: 0.005 to 1.2%;
Mn: 0.05 to 3.0%;
P: 0.001 to 0.2%;
S: 0.0001 to 0.05%;
T.Al: 0.005 to 1.5%;
Cu: 0 to 1.5%;
Ni: 0 to 10.0%;
Cr: 0 to 10.0%;
Mo: 0 to 1.5%;
Nb: 0 to 0.1%;
V: 0 to 0.3%;
Ti: 0 to 0.25%;
B: 0 to 0.005%;
REM: 0.00001 to 0.0020%; and
T.O: 0.0005 to 0.0050%,
with the balance being Fe and impurities
where T.Al in the defined as total content of Al.

4. The method for producing steel according to claim 3, wherein the chemical composition of the steel contains one or more elements selected from, in mass %:

Cu: 0.1 to 1.5%;
Ni: 0.1 to 10.0%;
Cr: 0.1 to 10.0%;

Mo: 0.05 to 1.5%;
Nb: 0.005 to 0.1%;
V: 0.005 to 0.3%;
Ti: 0.001 to 0.25%; and
B: 0.0005 to 0.005%.

5. The method for producing steel according to claim 1, wherein in the steel, a maximum diameter of alumina clusters is 100 μm or less.

6. The method for producing steel according to claim 5, wherein in the steel, numbers of alumina clusters having diameters of 20 μm or more are 2.0 clusters/kg or less.

7. The method for producing steel according to claim 2, wherein a chemical composition of the steel consists of, in mass %:

C: 0.0005 to 1.5%;
Si: 0.005 to 1.2%;
Mn: 0.05 to 3.0%;
P: 0.001 to 0.2%;
S: 0.0001 to 0.05%;
T.Al: 0.005 to 1.5%;
Cu: 0 to 1.5%;
Ni: 0 to 10.0%;
Cr: 0 to 10.0%;
Mo: 0 to 1.5%;
Nb: 0 to 0.1%;
V: 0 to 0.3%;
Ti: 0 to 0.25%;
B: 0 to 0.005%;
REM: 0.00001 to 0.0020%; and
T.O: 0.0005 to 0.0050%,
with the balance being Fe and impurities
where T.Al in the above is defined as total content of Al.

8. The method for producing steel according to claim 7, wherein the chemical composition of the steel contains one or more elements selected from, in mass %:

Cu: 0.1 to 1.5%;
Ni: 0.1 to 10.0%;
Cr: 0.1 to 10.0%;
Mo: 0.05 to 1.5%;
Nb: 0.005 to 0.1%;
V: 0.005 to 0.3%;
Ti: 0.001 to 0.25%; and
B: 0.0005 to 0.005%.

9. The method for producing steel according to claim 2, wherein in the steel, a maximum diameter of alumina clusters is 100 μm or less.

10. The method for producing steel according to claim 3, wherein in the steel, a maximum diameter of alumina clusters is 100 μm or less.

11. The method for producing steel according to claim 4, wherein in the steel, a maximum diameter of alumina clusters is 100 μm or less.

12. The method for producing steel according to claim 9, wherein in the steel, numbers of alumina clusters having diameters of 20 μm or more are 2.0 clusters/kg or less.

13. The method for producing steel according to claim 10, wherein in the steel, numbers of alumina clusters having diameters of 20 μm or more are 2.0 clusters/kg or less.

14. The method for producing steel according to claim 11, wherein in the steel, numbers of alumina clusters having diameters of 20 μm or more are 2.0 clusters/kg or less.

* * * * *